US007858950B2

(12) United States Patent
Dahl et al.

(10) Patent No.: US 7,858,950 B2
(45) Date of Patent: Dec. 28, 2010

(54) ELECTROSTATIC DISPERSION LENSES AND ION BEAM DISPERSION METHODS

(75) Inventors: David A. Dahl, Idaho Falls, ID (US); Anthony D. Appelhans, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 882 days.

(21) Appl. No.: 11/754,898

(22) Filed: May 29, 2007

(65) Prior Publication Data

US 2010/0264308 A1 Oct. 21, 2010

(51) Int. Cl.
*G21K 5/04* (2006.01)
*H01J 49/26* (2006.01)

(52) U.S. Cl. ..... 250/396 R; 250/396 ML; 250/281; 250/282

(58) Field of Classification Search ..... 250/396 R, 250/397, 398, 396 ML, 281, 282, 285, 294, 250/295, 296, 297, 298
See application file for complete search history.

(56) References Cited

U.S. PATENT DOCUMENTS 5,220,167 A * 6/1993 Brown et al. ..... 250/281
6,297,501 B1 * 10/2001 Merren ..... 250/296
2005/0189486 A1 * 9/2005 Fuhrer et al. ..... 250/287
2005/0279933 A1 * 12/2005 Appelhans et al. ..... 250/296

* cited by examiner

*Primary Examiner*—Robert Kim
*Assistant Examiner*—Nicole Ippolito Rausch
(74) *Attorney, Agent, or Firm*—Wells St. John

(57) ABSTRACT

An EDL includes a case surface and at least one electrode surface. The EDL is configured to receive through the EDL a plurality of ion beams, to generate an electrostatic field between the one electrode surface and either the case surface or another electrode surface, and to increase the separation between the beams using the field. Other than an optional mid-plane intended to contain trajectories of the beams, the electrode surface or surfaces do not exhibit a plane of symmetry through which any beam received through the EDL must pass. In addition or in the alternative, the one electrode surface and either the case surface or the other electrode surface have geometries configured to shape the field to exhibit a less abrupt entrance and/or exit field transition in comparison to another electrostatic field shaped by two nested, one-quarter section, right cylindrical electrode surfaces with a constant gap width.

36 Claims, 14 Drawing Sheets

FIG. II

ELECTROSTATIC DISPERSION LENSES AND ION BEAM DISPERSION METHODS

CONTRACTUAL ORIGIN OF THE INVENTION

The United States Government has certain rights in this invention pursuant to Contract No. DE-AC07-05ID14517 between the United States Department of Energy and Battelle Energy Alliance, LLC.

TECHNICAL FIELD

The invention pertains to electrostatic dispersion lenses and ion beam dispersion methods.

BACKGROUND OF THE INVENTION

U.S. Pat. No. 6,984,821, issued Jan. 10, 2006 to Appelhans et al., (hereinafter "Appelhans '821") describes methods and apparatuses for increasing dispersion between ion beams. The goal of Appelhans '821 is to enhance the dispersion between ion beams, without regard to the energy of ions in the beams, where the beams were initially separated in space according to mass-to-charge ratio (m/z) by a magnetic sector field. Due to physical size constraints of ion detection technology, increasing dispersion of such mass separated beams is advantageous to simplify concurrent detection of the beams. The Appelhans '821 electrostatic dispersion lens (EDL) uses an electrostatic field shaped by two nested, one-quarter section, right cylindrical electrodes held at opposite voltages with a constant gap width between the cylindrical electrodes. At least FIGS. 5A-5F and the associated text of Appelhans '821 demonstrate the principles involved. Further study of the Appelhans '821 EDL revealed that improvements in EDL design and performance were desirable.

SUMMARY OF THE INVENTION

In one aspect of the invention, an EDL includes a case surface and at least one electrode surface. The EDL is configured to receive through the EDL a plurality of spatially separated ion beams, to generate an electrostatic field between the one electrode surface and either the case surface or another electrode surface, and to increase the separation between the beams using the field. Other than an optional mid-plane intended to contain trajectories of the beams, the electrode surface or surfaces do not exhibit a plane of symmetry through which any beam received through the EDL must pass.

In another aspect of the invention, an EDL includes a case surface and at least one electrode surface. The EDL is configured to receive through the EDL a plurality of spatially separated ion beams, to generate an electrostatic field between the one electrode surface and either the case surface or another electrode surface, and to increase the separation between the beams using the field. The one electrode surface and either the case surface or the other electrode surface have geometries configured to shape the field to exhibit a less abrupt entrance and/or exit field transition in comparison to another electrostatic field. The other electrostatic field is shaped by two nested, one-quarter section, right cylindrical electrode surfaces held at opposite voltages with a constant gap width between the cylindrical electrode surfaces.

BRIEF DESCRIPTION OF THE DRAWINGS

Preferred embodiments of the invention are described below with reference to the following accompanying drawings.

FIG. 1 shows a SIMION simulation of operating the Appelhans '821 EDL.

FIG. 10 shows a perspective sectional view of the EDL in FIG. 8.

FIG. 14 shows a SIMION simulation of operating the EDL in FIG. 8.

FIG. 15 shows a cut-away perspective view of a controlled field transition EDL according to a further aspect of the invention.

FIG. 16 shows a SIMION simulation of operating the EDL in FIG. 15.

DETAILED DESCRIPTION OF THE INVENTION

Figure 11:
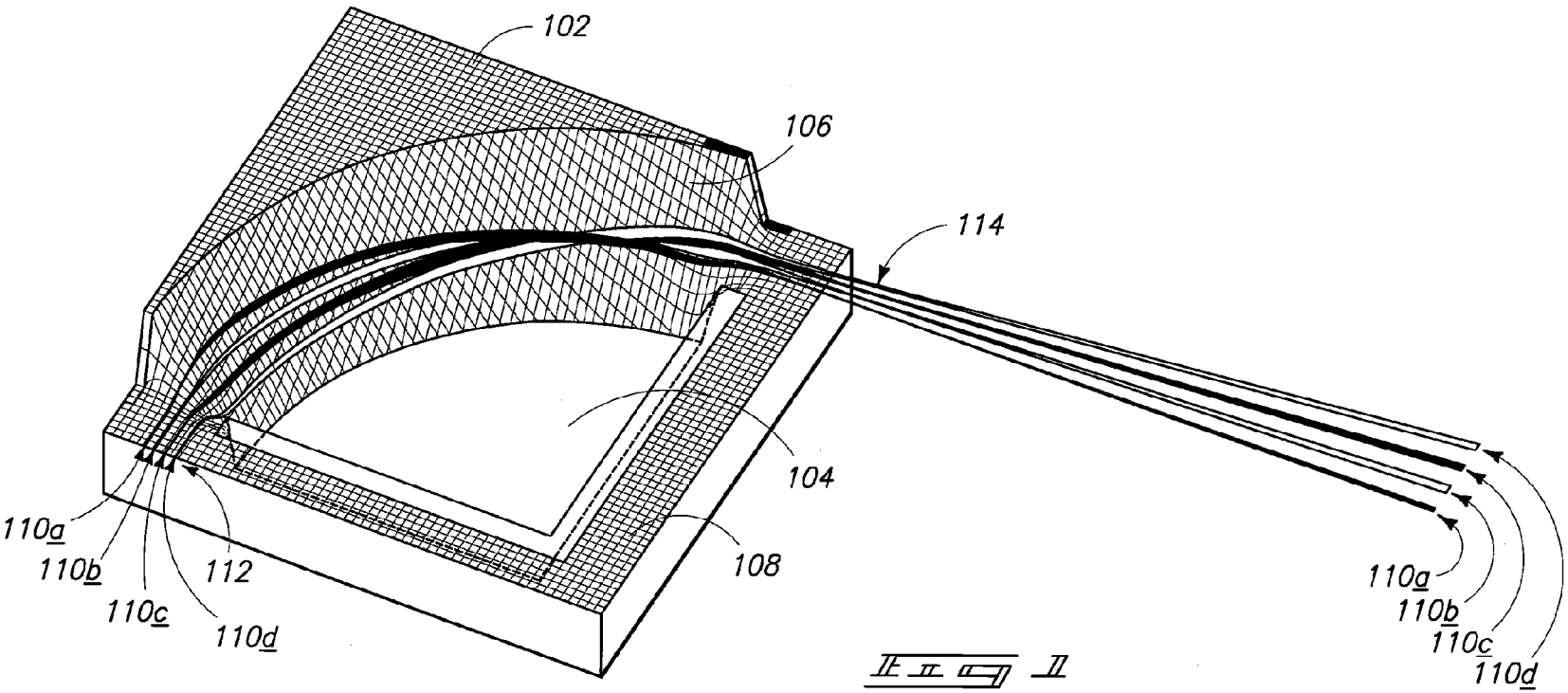
FIG. 11 shows a side view of the EDL in FIG. 8.

FIG. 1 of the present application shows a view of a potential energy surface resulting from a SIMION computer simulation of the Appelhans '821 EDL. SIMION software for electron and ion optics simulation is available from Scientific Instrument Services in Ringoes, N.J. The simulation in FIG. 1 was performed with SIMION 3-D version 7.0 specifying beams of singly charged ions having m/z of 136, 135, 134, and 133 as respective ion beams 110*a*, 110*b*, 110*c*, and 110*d*. In the simulation, beams 110*a-d* share a common kinetic energy of 5 keV. The simulation output in FIG. 1 includes an upper potential 102 at +5000 volts and a lower potential 104 at −5000 volts (10,000 volts difference) with an energy surface 106 between the two potentials simulating an electrostatic field generated between two electrodes having a surface shape and separation as shown in FIG. 1 for upper potential 102 and lower potential 104. A mid-plane 108 in FIG. 1 represents a z-axis (vertical axis) focus plane for beams 110*a-d* entering the simulated Appelhans '821 EDL.

As is apparent from FIG. 1, beams 110*a-d* exhibit an entry focus 112 and an exit focus 114. A field transition region exists where beams 110*a-d* move onto the slope of energy surface 106 and some beams move above or below mid-plane 108. The field transition region simulates the entry of beams 110*a-d* into an electrostatic field which acts to decelerate some beams, such as beam 110*d*, and to accelerate other beams, such as beam 110*a*. Therefore, even though the kinetic energy of beams 110*a-d* may be the same prior to entering the field transition region, the kinetic energy of beams within the EDL may vary significantly between beams.

Graphically speaking, beam 110*d* drops down to a low position on energy surface 106 upon entering the field transition region. Conversely, beam 110*a* rises up to a high position on energy surface 106. Due to their simulated position on energy surface 106, beams 110*a*-110*d* are turned different amounts. Literally speaking, the beams' positions within the electrostatic field may differentially change the kinetic energy, and thus the trajectory, of the beams while in the field. However, in actuality, the change in trajectory does not mean that the beams move up or down out of the z-axis focus plane as shown in FIG. 1 for a potential energy surface simulation.

Upon exiting through another field transition region, as shown graphically in FIG. 1, beams 110*a-d* move off energy surface 106 and return to mid-plane 108. Literally, the beams leave the electrostatic field and return to a common kinetic energy. The new trajectories induced by passage through the EDL provide enhanced dispersion of beams 110*a-d*.

The field transition regions onto and off of energy surface 106 are shown in FIG. 1 as being rather sharp. The sharp field transition regions symbolize a correspondingly sharp change in kinetic energy as beams enter the electrostatic field simulated by FIG. 1. Since the change in beam kinetic energy depends upon beam position in the electrostatic field, a sharp field transition region creates very narrow positional and dimensional tolerances for proper functioning of the EDL to enhance dispersion.

Despite the enhanced dispersion shown in FIG. 1, the existence of exit focus 114 indicates the beginning of beam broadening. That is, the secondary beam focus point beyond the EDL exit represented by exit focus 114 produces enhanced fanning out of individual beams. Beam broadening is apparent from the simulation shown in FIG. 1 as beams 110*a-d* move along their trajectories after exiting the EDL. Broadening of one beam relative to another may depend on several factors, including the focus point of a beam after magnetic or other separation, position of the beam within the EDL field, and other complex factors. Not only is beam broadening itself problematic, variability in broadening between beams may create further challenges. Beam broadening is especially problematic and degrades effective dispersion as beam width starts to approach beam-to-beam separation.

Since beam dispersion may alleviate size constraints in ion detection equipment, beam broadening might reduce the potential advantage of dispersing beams by pushing detection equipment back into closer proximity to encompass the entire beam width. A first ratio of beam spacing relative to beam width may exist at the input to the EDL and a second ratio of beam spacing relative to beam width may exist after the output from the EDL at the point of detection. Dispersion of beams acts to make the second ratio larger than the first ratio, but broadening of beams counteracts the increase and brings the second ratio back closer to or less than the first ratio. Ultimately, at the point of detecting dispersed beams, if the second ratio is greater than or equal to the first ratio, then the EDL might function to relieve physical constraints in ion detection equipment. Even if the ratio stays constant, when the beam width is within the requirements of the detector and the detectors can fit between the dispersed beams, then an advantage of dispersing beams might be achieved. Variability in beam broadening may produce differences in selecting the size and/or configuration of detection equipment depending on the extent of broadening and, thus, might further complicate ion detection.

Observation indicated the existence of competing design goals for an EDL. Primary design goals include avoiding variance in beam-to-beam dispersion when at least three beams are present while providing the widest angular dispersion, avoiding divergence of beam profiles (beam broadening), and improving z-axis focusing of the beams. A series of SIMION simulations were conducted, exploring EDL designs alternative to the Appelhans design of U.S. Pat. No. 6,984,821 for which a SIMION simulation is shown in FIG. 1. Observation indicated that introducing certain asymmetries yielded the most promising results.

The Appelhans '821 EDL uses two nested, one-quarter section, right cylindrical electrode surfaces held at opposite voltages with a constant gap width between the cylindrical electrode surfaces. Reference herein to such electrode surfaces as one-quarter section, right cylindrical electrode surfaces describes only the surfaces of such electrodes from which the electrostatic field employed in dispersing ion beams is generated. The geometry of such surfaces may be appreciated throughout Appelhans '821, in particular, FIGS. 5A-5F. In addition to a mid-plane containing intended trajectories of the beams, Appelhans '821 includes two electrode surfaces that exhibit a common plane of symmetry through which any beam received through the EDL must pass. The plane of symmetry bisects both of the one-quarter section, right cylindrical electrodes.

Instead of using a symmetrical cylindrical EDL, asymmetrical designs may provide an EDL improving performance of one or more of the competing design goals discussed above in comparison to the Appelhans '821 EDL. As will be appreciated from the description herein, selected asymmetries may be used to tailor a particular EDL design to provide significant improvement in achieving one or two of the design goals, while perhaps not addressing another design goal in comparison to the Appelhans '821 symmetrical cylindrical EDL. Depending on the system in which the EDL is used, the design goal(s) of particular importance may be selected for enhancement, perhaps at the intended sacrifice of improving or even conserving performance of other design goals of less importance in the context of the particular system.

According to one aspect of the invention, an EDL includes a case surface and at least one electrode surface. The EDL is configured to receive through the EDL a plurality of spatially separated ion beams, to generate an electrostatic field between the one electrode surface and either the case surface or another electrode surface, and to increase the separation between the beams using the field. Other than an optional mid-plane intended to contain trajectories of the beams, the electrode surface or surfaces do not exhibit a plane of symmetry through which any beam received through the EDL must pass.

By way of example, the EDL may be configured to receive the beams with equal kinetic energies upon entering the field. Also, the one electrode surface and either the case surface or the other electrode surface may have geometries configured to shape the field to exhibit a less abrupt entrance and/or exit field transition in comparison to another electrostatic field. Such other electrostatic field may be shaped by two nested, one-quarter section, right cylindrical electrode surfaces held at opposite voltages with a constant gap width between the cylindrical electrode surfaces. Appelhans '821 generates one such electrostatic field. However, in the aspects of the invention herein, geometries may be selected to control the field transition so that certain design goals may be addressed. An EDL with a controlled field transition may exhibit properties not previously addressed in known electrostatic fields.

A variety of uses may exist for the controlled field transition EDL in the present aspect of the invention as well as other aspects of the invention, including use in a mass spectrometer, as described in Appelhans '821. Another possible application includes use in mass separators. Mass separators may exist in various types of specialized processing equipment used to produce quantities of mass separated elements or molecular species collected for future use. Mass spectrometers for multiple-isotope elements are used in a variety of applications ranging from geochronology to nuclear forensics.

Even though separation may be accomplished with a magnetic sector field, other separation methods and/or apparatuses may be used. Ion beams separated by any means and having the same energy may function in the controlled field transition EDL in the same manner as described for mass separated beams. The controlled field transition EDL is mass independent. Thus, no requirement exists that the beams be mass separated or otherwise contain segregated ions of different masses. Consequently, applications beyond mass spectrometry may exist. Suitable applications include those producing two or more beams containing ions having the same charge, both in quantity (that is, singly charged, doubly charged, etc.) and polarity (that is, all positive or all negative), where dispersion between the beams is desired.

A variety of possible asymmetrical designs exist. Some designs, such as those described herein, perform better at achieving one or more of the competing design goals for an EDL in comparison to other asymmetrical designs. For example, the at least one electrode surface mentioned above may be an outer electrode surface including a one-quarter section, right cylindrical electrode surface as the one electrode surface. The other electrode surface mentioned above may be a nested inner electrode surface including a one-quarter section, right cylindrical portion and a tangential extension portion. The extension portion may be positioned at an entrance to the field and a constant gap width may exist between the outer electrode surface and the cylindrical portion of the inner electrode surface.

Figure 4:
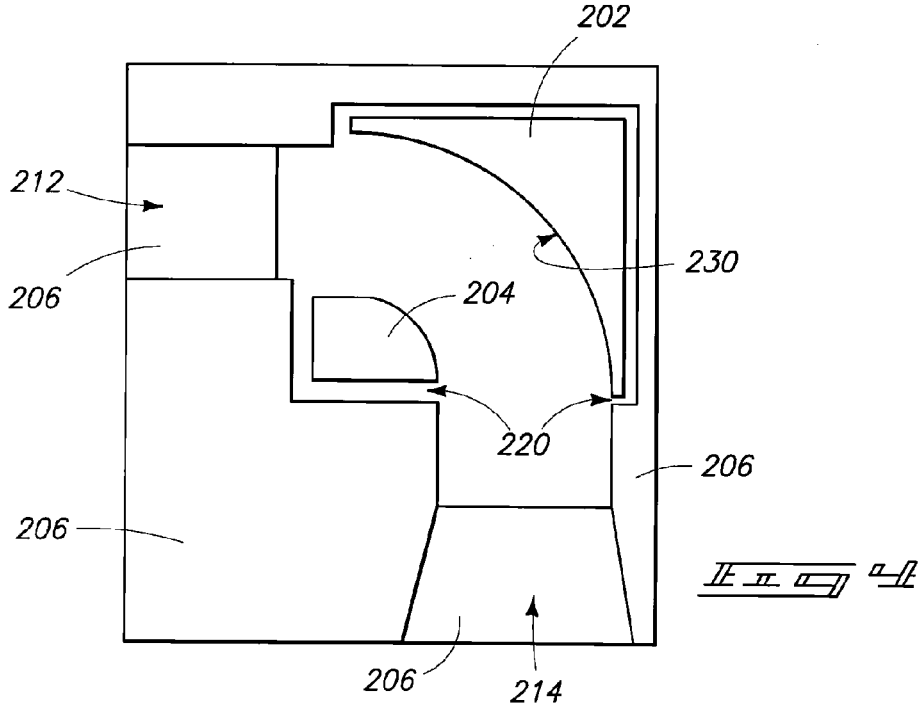
FIGS. 4 and 5 show respective top and perspective views of a controlled field transition EDL according to one aspect of the invention.
Figure 5:
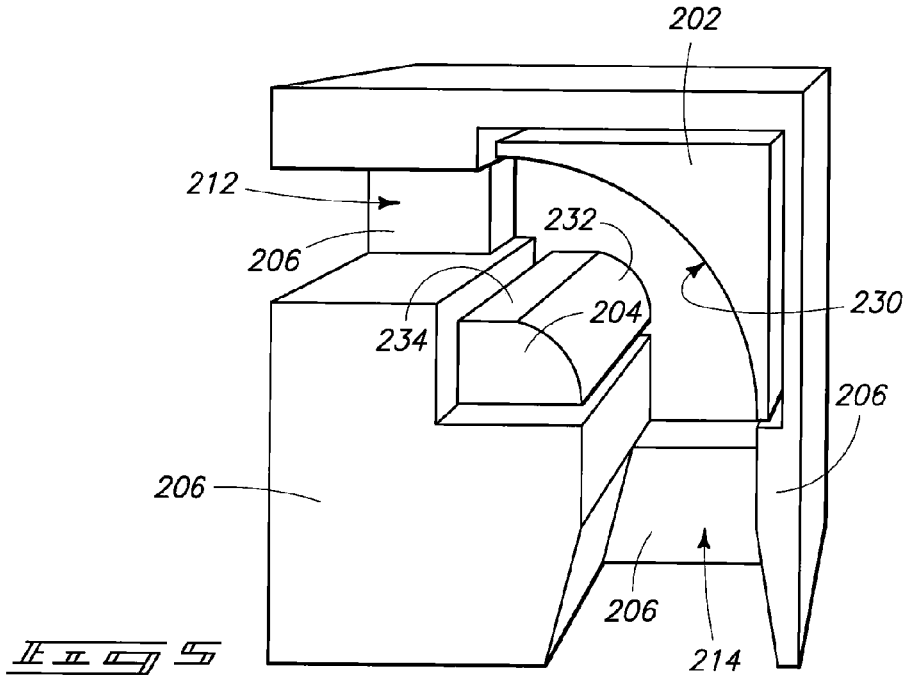

FIGS. 4 and 5, respectively, show a top view and a perspective view of an EDL similar to that of Appelhans '821 but including a tangential extension of one electrode to provide a modified electrostatic field. The EDL in FIGS. 4 and 5 includes an outer electrode 202 and a nested inner electrode 204 positioned within a case 206. Notably, gaps 220 exist between electrodes 202, 204 and case 206 to electrically isolate the components. In this manner, outer electrode 202 may be held at a positive potential while inner electrode 204 may be held at a negative potential and case 206 may be at ground potential. The EDL of FIGS. 4 and 5 also includes an entry aperture 212 through which ion beams enter and an exit aperture 214 through which ion beams exit.

Outer electrode 202 includes a one-quarter section, right cylindrical electrode surface 230. Inner electrode 204 includes an electrode surface with a one-quarter section, right cylindrical portion 232 and a tangential extension portion 234. Extension portion 234 is positioned at what will become an entrance to an electrostatic field generated between outer electrode surface 230 and cylindrical portion 232/tangential portion 234. A constant gap width exists between outer electrode surface 230 and cylindrical portion 232 of inner electrode 204.

Figure 3:
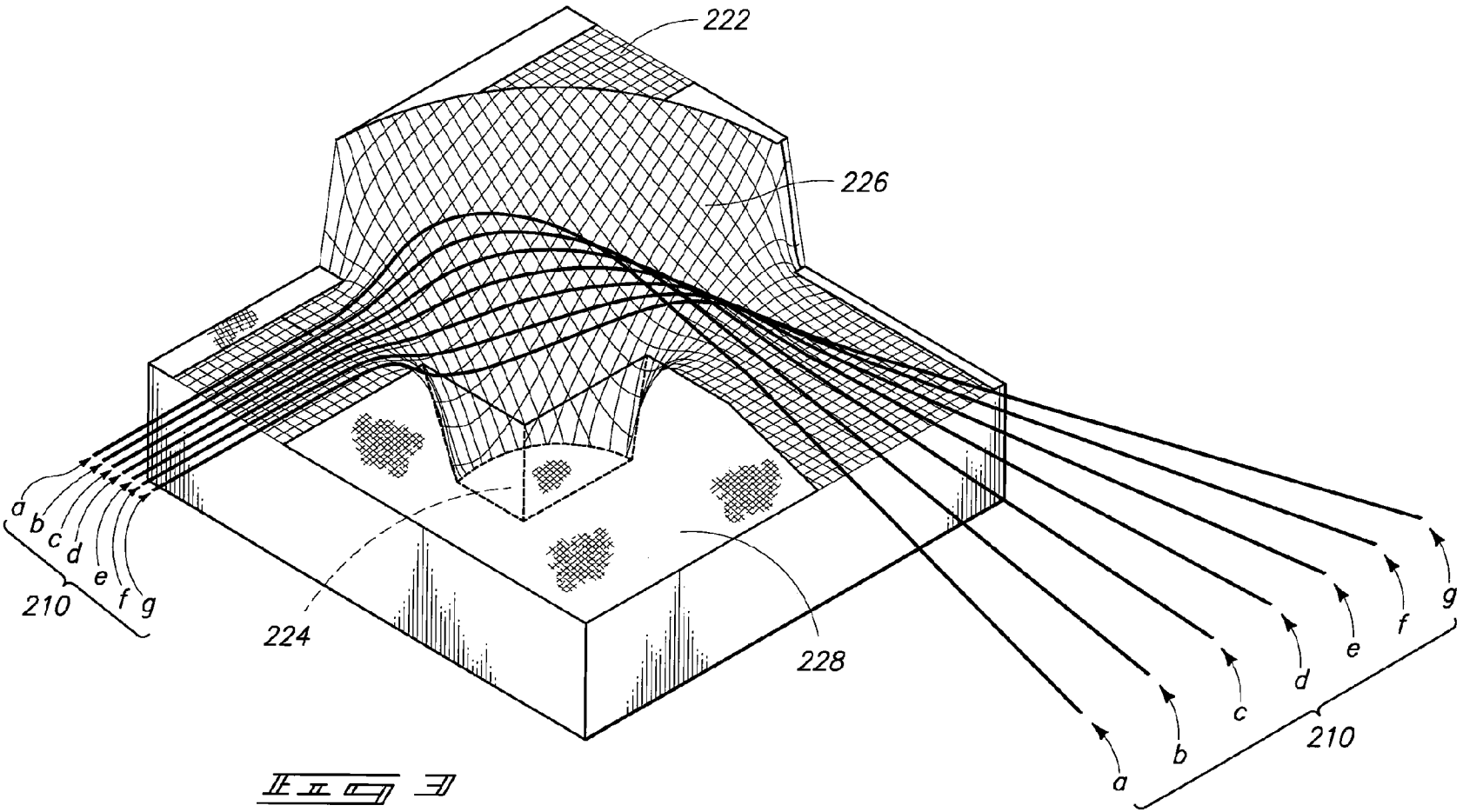
FIG. 3 shows a SIMION simulation of operating the EDL in FIGS. 4 and 5.

FIG. 3 shows a view of a potential energy surface resulting from a SIMION computer simulation of the EDL in FIGS. 4 and 5. The simulation used ion beams 210*a-g*, which share a common kinetic energy of 5 kilovolts (kV). The simulation output in FIG. 1 includes an upper potential 222 at +5000 V and a lower potential 224 at −5000 V with an energy surface 226 between the two potentials simulating an electrostatic field generated between outer electrode 202 and inner electrode 204. A mid-plane 228 in FIG. 3 represents a z-axis focus plane for beams 210*a-g* before moving on and after moving off the slope of energy surface 226. Beams 210*a-g* follow a trajectory similar to that shown for beams 110*a-d* in FIG. 1, but with several improvements discussed herein.

A field transition region exists where beams 210*a-g* move onto the slope of energy surface 226 and some beams move above or below mid-plane 228. The field transition region simulates beams 210*a-g* entry into an electrostatic field as described with regard to FIG. 1. Accordingly, due to their simulated positions on energy surface 226, beams 210*a-g* are turned different amounts. In comparison to energy surface 106 shown in FIG. 1, the field transition region onto energy surface 226 is less sharp. The asymmetry introduced into the EDL shown in FIGS. 4 and 5 using tangential extension portion 234 of inner electrode 204 greatly smoothes the field transition region. Also, evaluation of the simulation output revealed that an exit focus, such as exit focus 114 shown in FIG. 1, was not readily observable.

Essentially eliminating the exit focus significantly narrowed beams 210*a-g* in the dispersion direction compared to beams 110*a-d*. Consequently, the SIMION output also showed that a ratio of beam spacing-to-beam width improved to approximately 15:1 in the controlled field transition EDL of FIGS. 4 and 5 compared to about 8:1 in the Appelhans '821 EDL. Angular displacement between beams was relatively constant, producing little, if any, variance in beam-to-beam dispersion.

Figure 2:
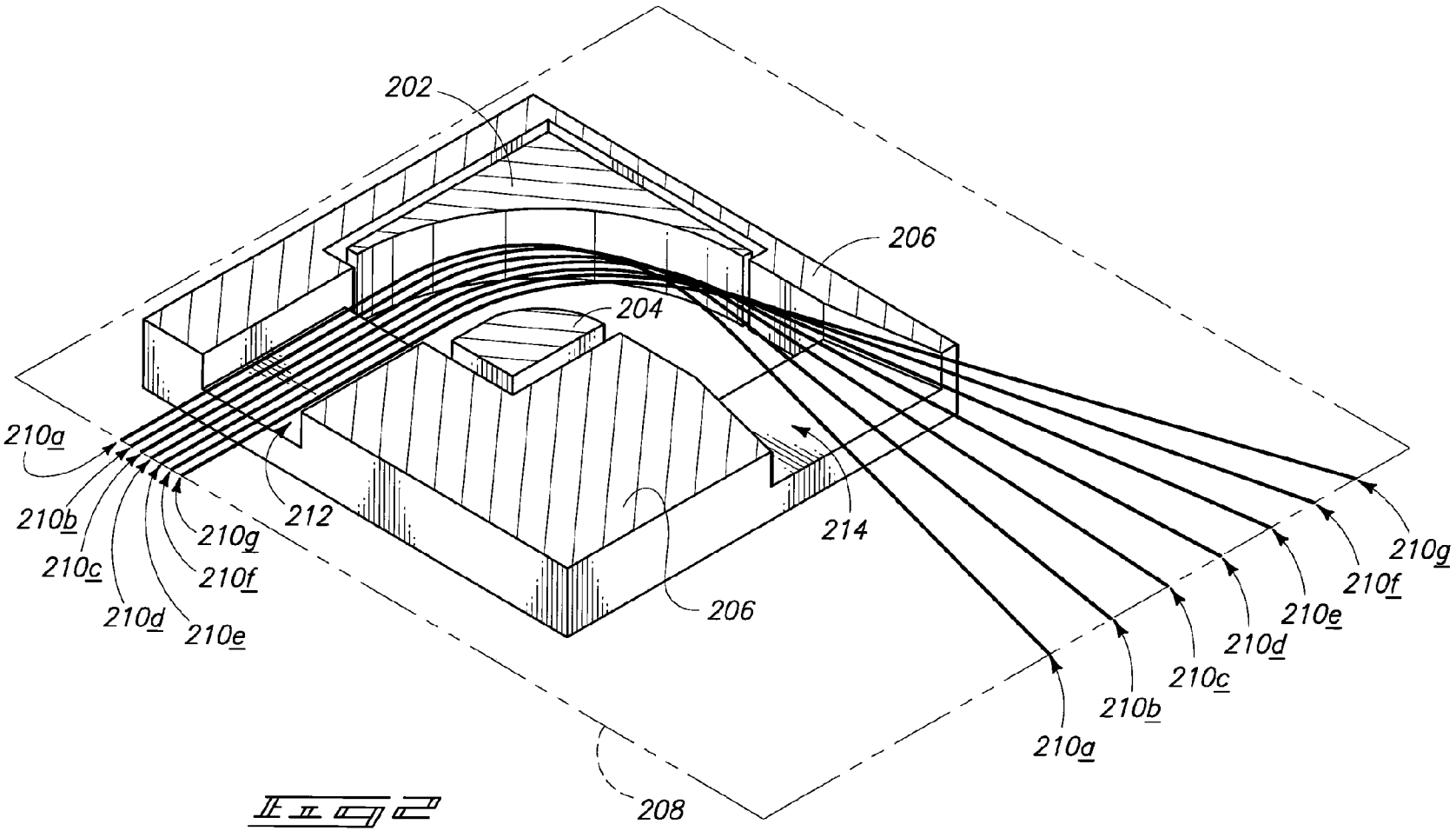
FIG. 2 shows a perspective view of a mid-plane section taken through the EDL in FIGS. 4 and 5.

FIG. 2 shows a perspective, sectional view taken along a mid-plane 208 of the EDL in FIGS. 4 and 5. Mid-plane 208 corresponds to a z-axis focus plane for beams 210*a-g*. Electrode surface 230, cylindrical portion 232, and tangential portion 234 also exhibit a plane of symmetry corresponding to mid-plane 208. That is, the surfaces of electrodes 202 and 204 include a planar symmetrical design along the z-axis (vertical direction). As a result, the z-focusing characteristics of the electrostatic field generated in the EDL of FIGS. 4 and 5 are not significantly different from the z-focusing characteristics of the electric field generated in the Appelhans '821 device. Thus, z-axis focusing of beams is conserved.

As is readily apparent, other than mid-plane 208 intended to contain trajectories of beams 210*a-g*, electrode surface 230, cylindrical portion 232, and tangential portion 234 in combination do not exhibit a plane of symmetry through which any beam received through the EDL must pass. The introduced asymmetries thus address the primary design goals discussed above. Even though the design does not improve z-axis focusing, it is conserved.

Figure 6:
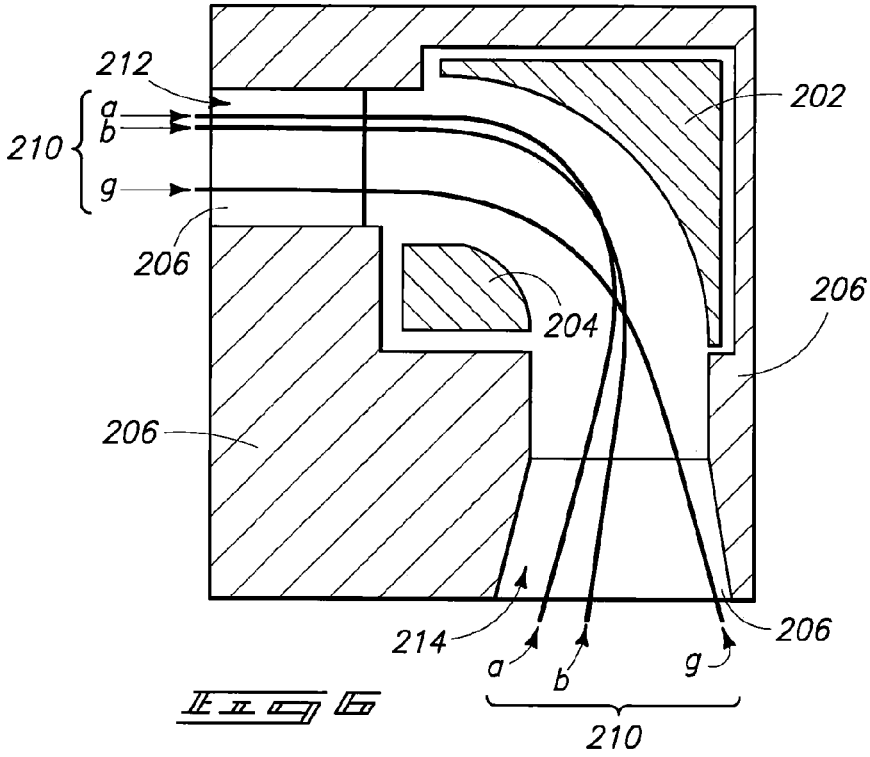
FIG. 6 shows a sectional view of the EDL in FIGS. 4 and 5.
Figure 7:
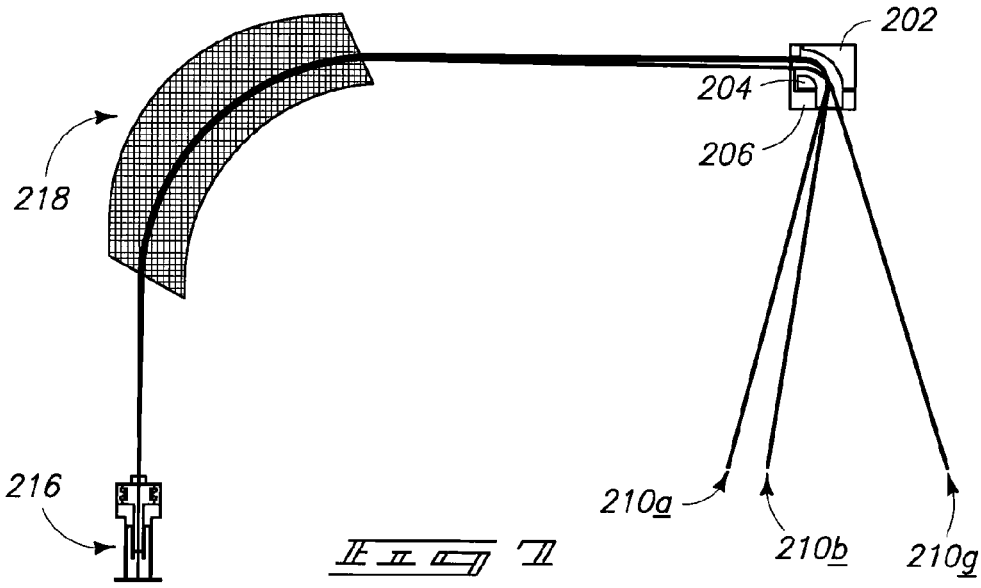
FIG. 7 shows a diagrammatic view of a system incorporating the EDL of FIGS. 4 and 5.
Figure 8:
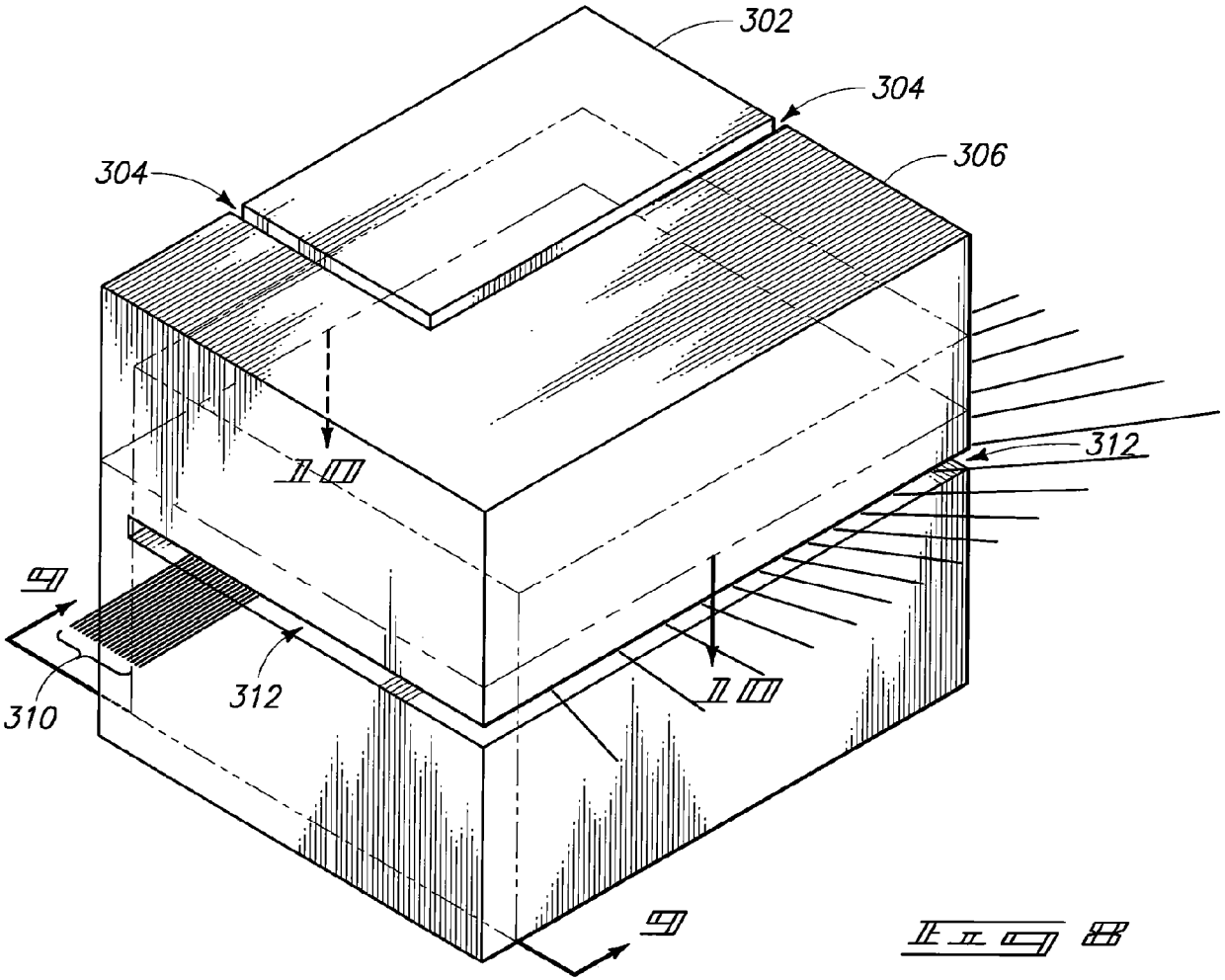
FIG. 8 shows a perspective view of a controlled field transition EDL according to another aspect of the invention.
Figure 9:
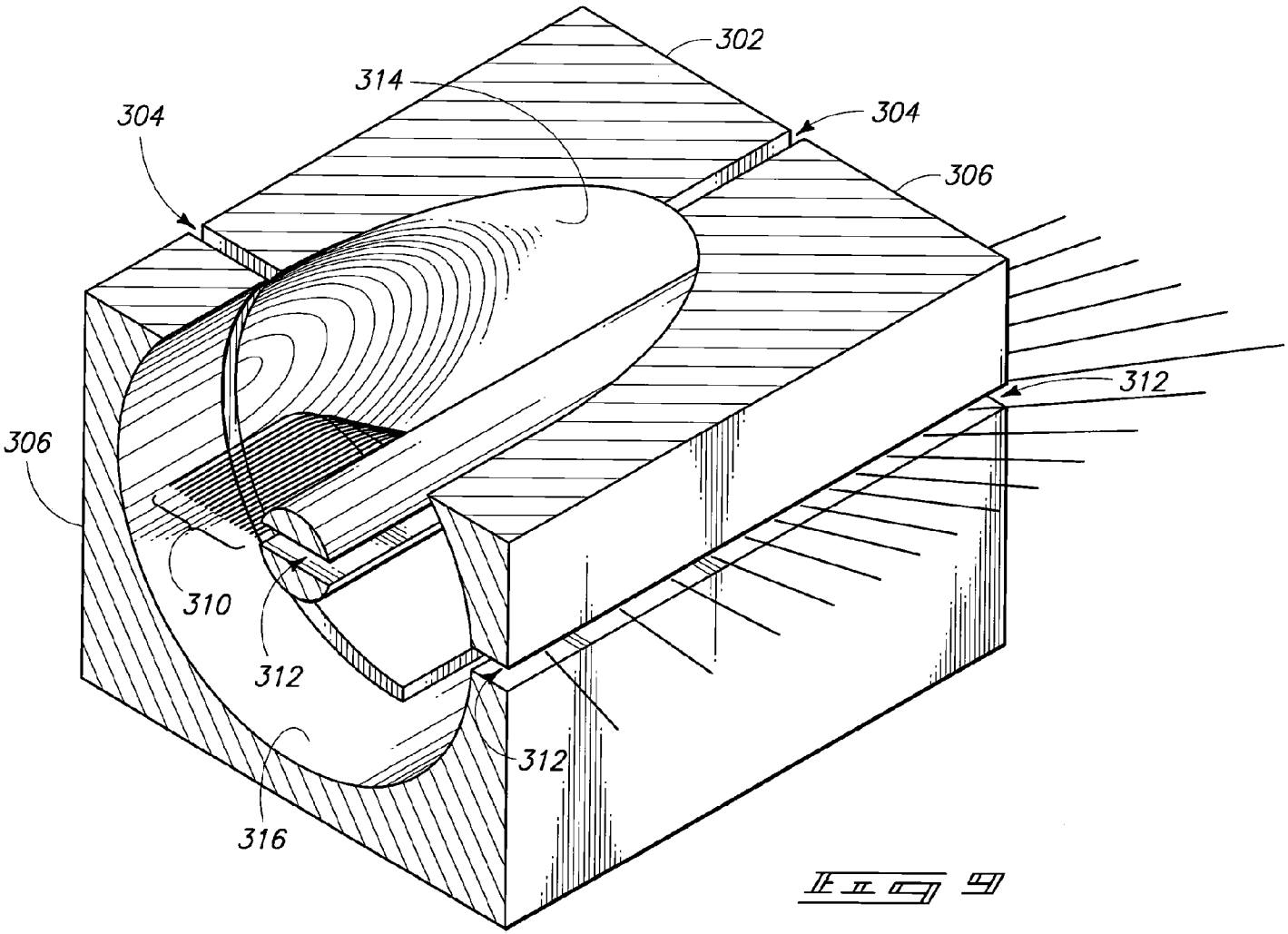
FIG. 9 shows a perspective, dual-sectional view of the EDL in FIG. 8.
Figure 11:
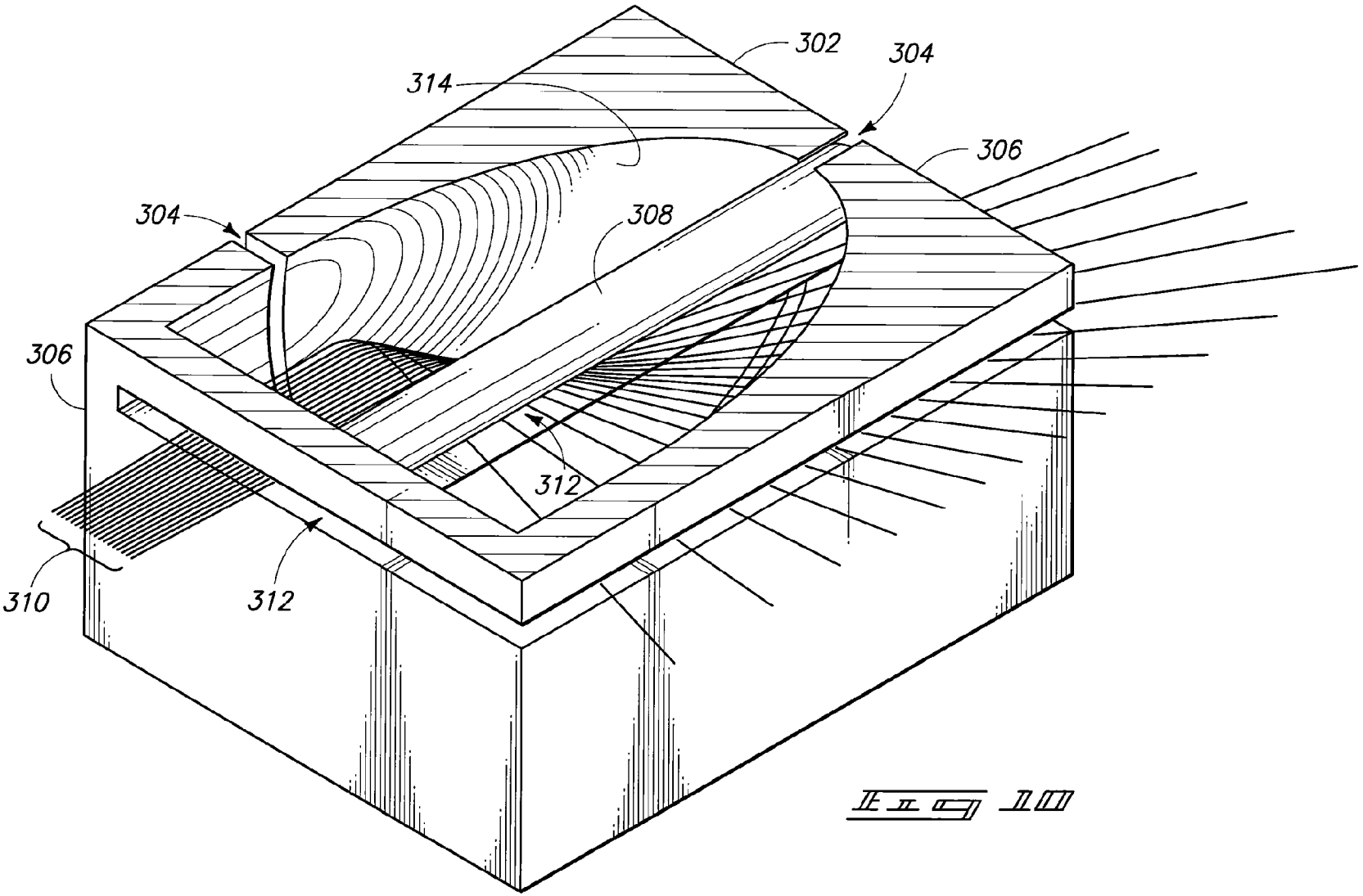
Figure 11:
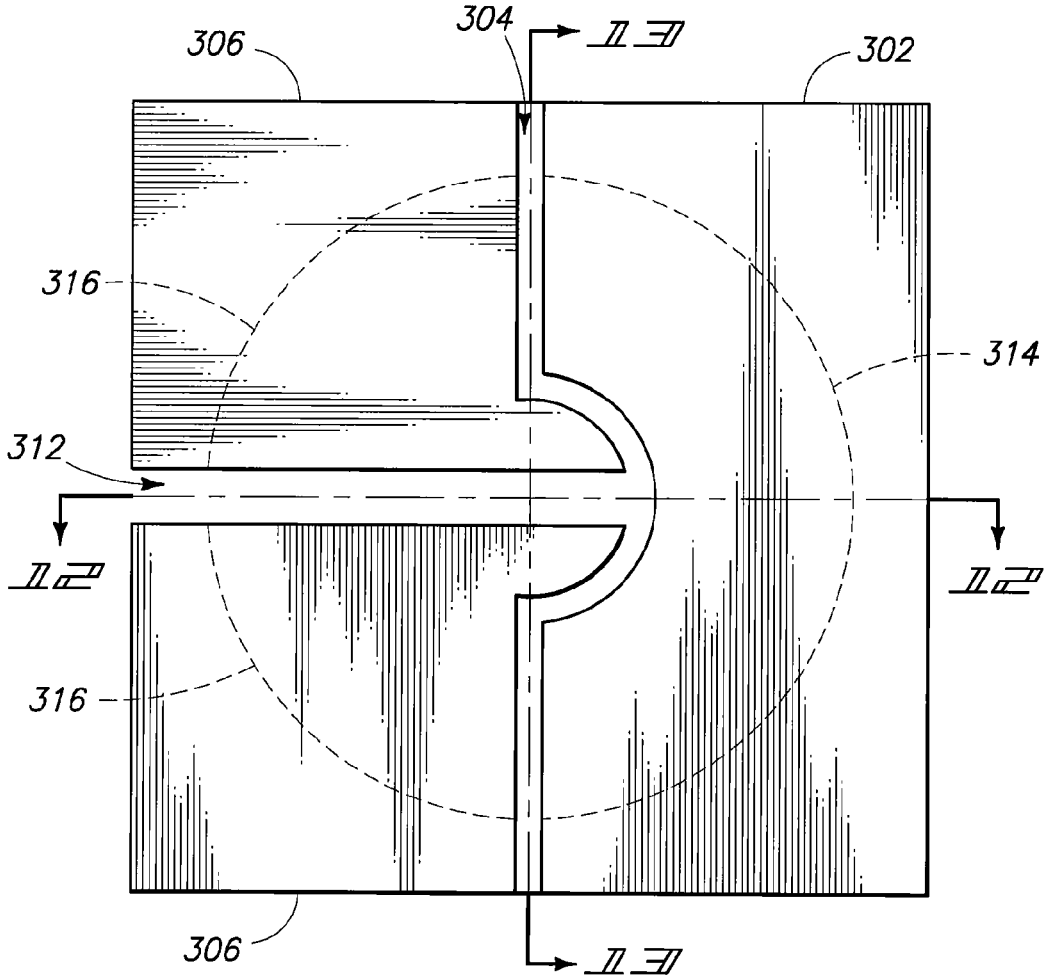
Figure 12:
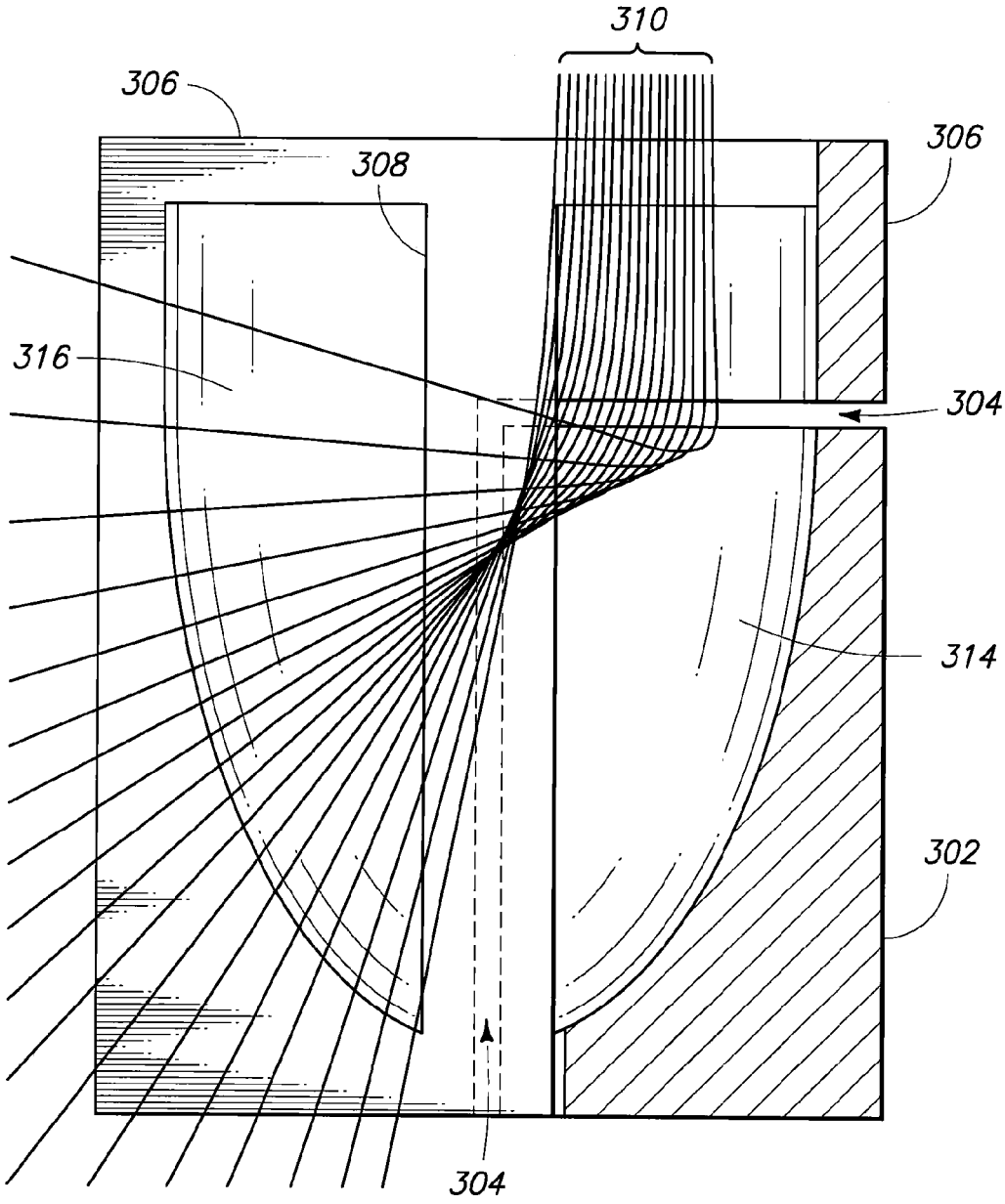
FIGS. 12 and 13 show sectional views of the EDL in FIG. 8 taken along respective lines 12-12 and 13-13 shown in FIG. 11.
Figure 13:
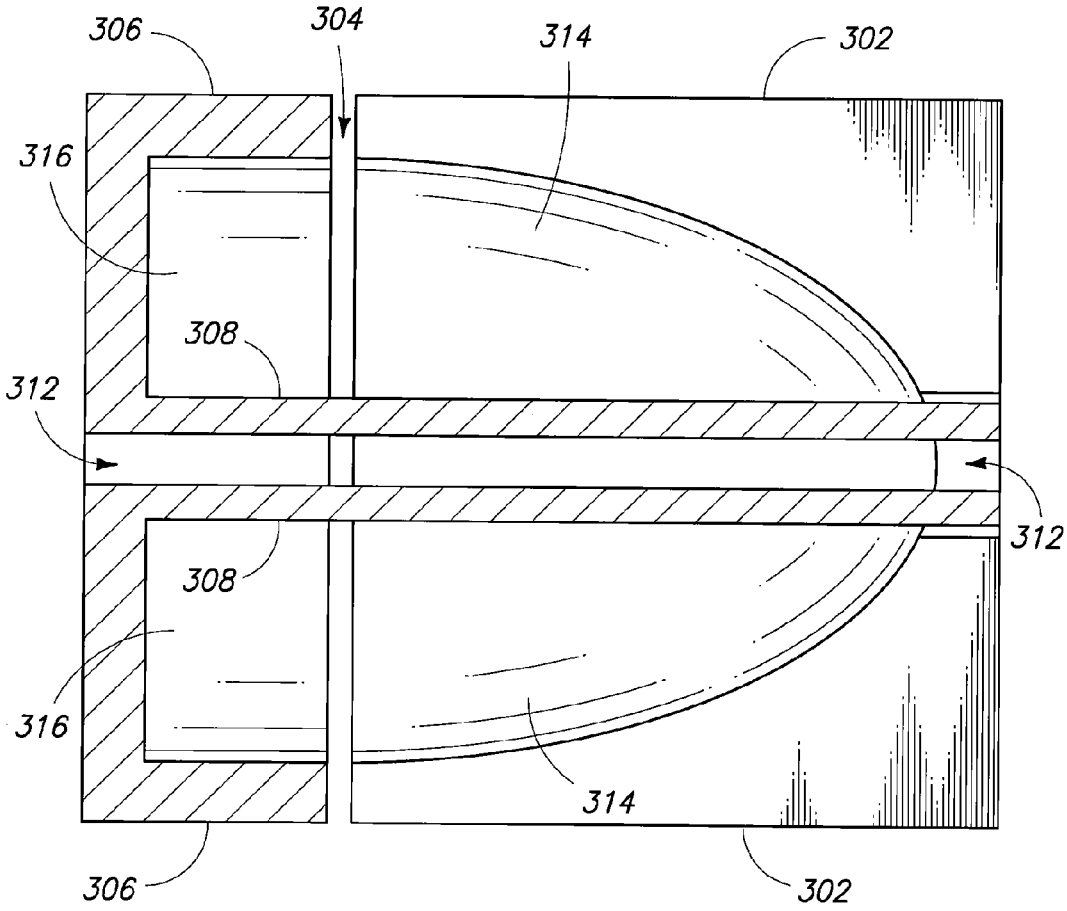
Figure 11:
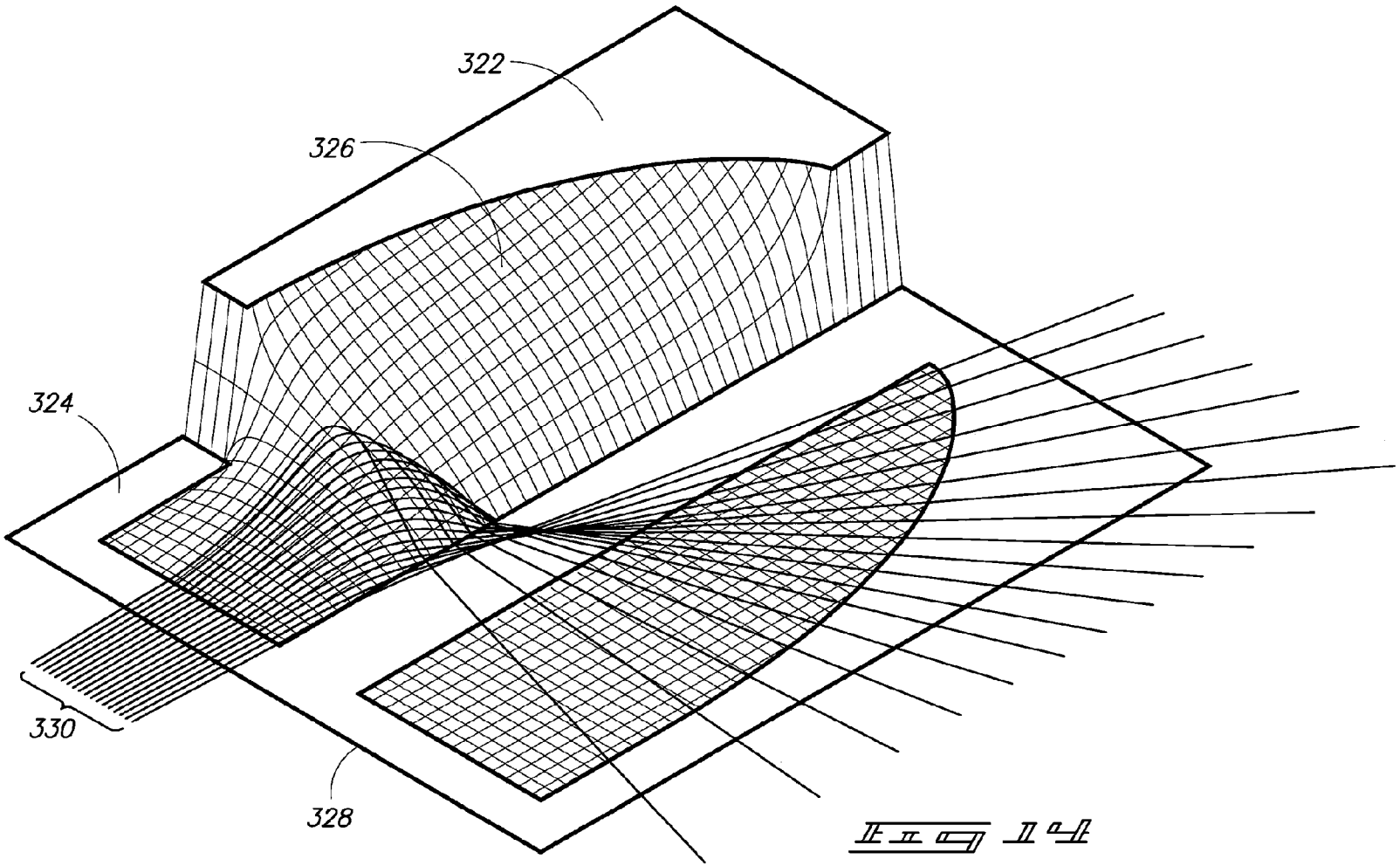
Figure 11:
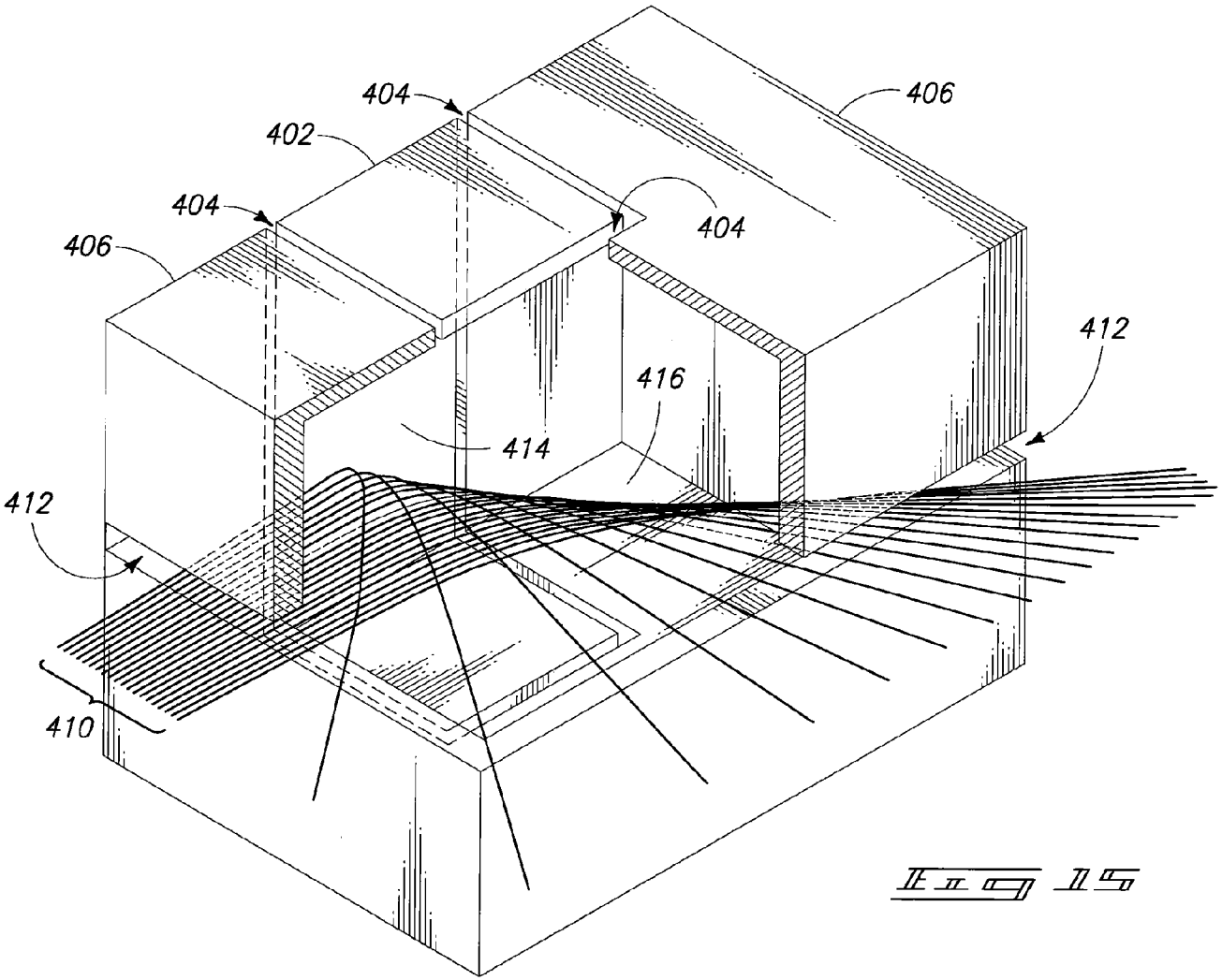
Figure 11:
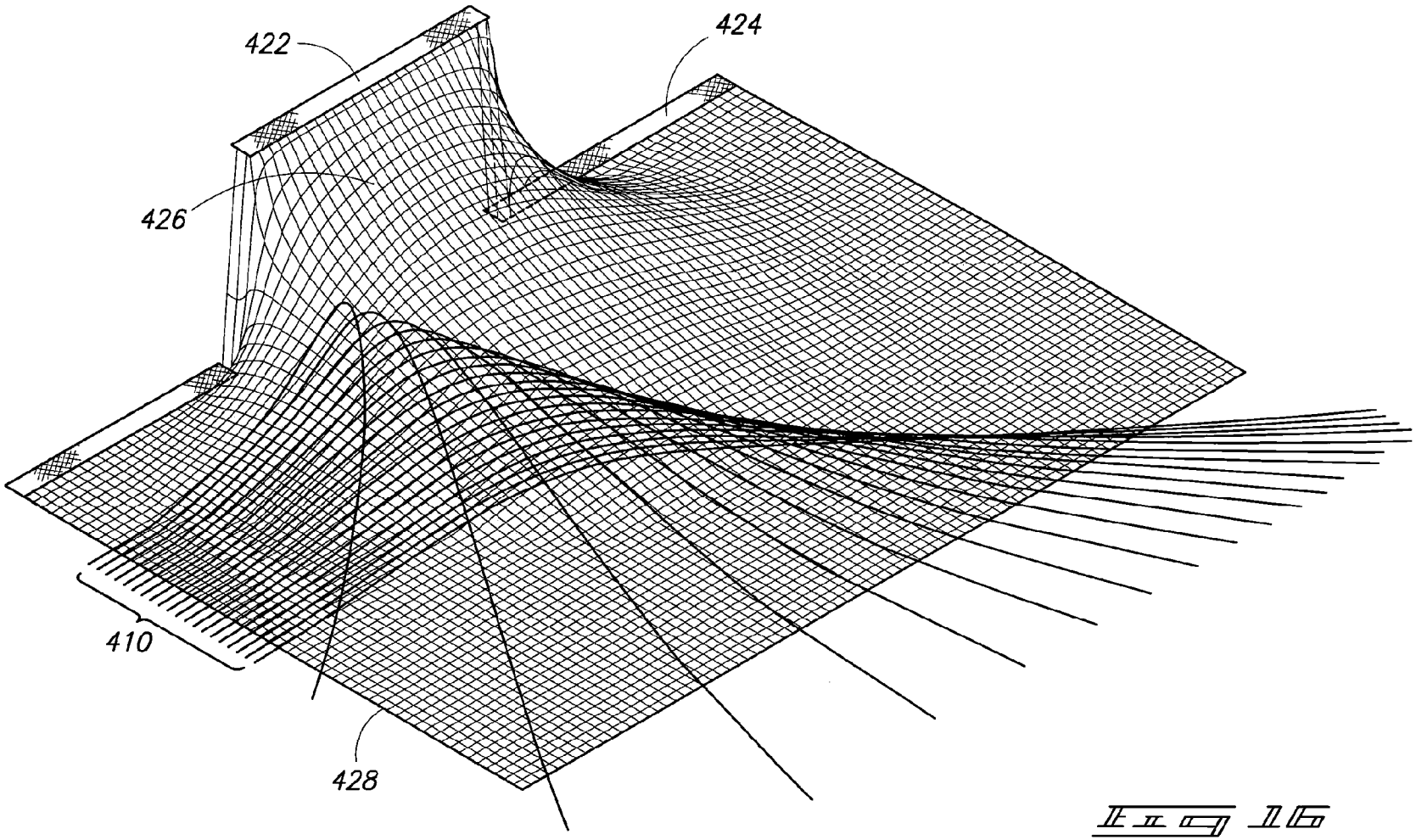

FIGS. 6 and 7 show one hypothetical example of using the controlled field transition EDL of FIGS. 2, 4, and 5 in a system including an ion source 216 and a magnetic sector 218 to provide a plurality of ion beams spatially separated according to mass and having equal kinetic energies upon entering an electrostatic field generated in the EDL. The structure and function of ion source 216 and magnetic sector 218 may be appreciated from Appelhans '821 and/or other references known to those of ordinary skill FIG. 6 shows an enlarged view of the EDL in FIG. 7 as a top sectional view taken along mid-plane 208 as in FIG. 2. However, FIGS. 6 and 7 show only three ion beams. In this hypothetical example, ion beam 210*a* exhibits a m/z of 244, ion beam 210*b* exhibits a m/z of 243, and ion beam 210*g* exhibits a m/z of 238.

Magnetic sector 218 includes a standard double dispersion magnet, which has a magnet focal plane exhibiting a considerable "tilt." The tilt refers to the focal point of the lighter m/z 238 ion beam (beam 210*g*) occurring at a different point along the beams' trajectory in comparison to the focal point for the m/z 244 ion beam (beam 210*a*). In other words, due to the magnetic field, a line connecting the focal points of the beams is not perpendicular to the beams' trajectory, but is instead "tilted" at a non-normal angle to the beams' trajectory. In Appelhans '821, positioning an EDL such that the beams' focal points occur just prior to entering the electrostatic field of the EDL appeared to produce the best results. If the Appelhans '81 EDL was positioned with the focal point of beam 210*a* at the optimum distance into the EDL, then the focal point of beam 210*g* fell short of the EDL.

Modifying the Appelhans '821 EDL by extending inner electrode 204 toward entrance aperture 212 allows beam 210*g* containing m/z 238 to be shaped by the electrostatic field sooner, which avoids divergence of the beam 210*g* profile without degrading the beam 210*a* profile containing m/z 244. One of the competing design goals described above includes providing electrode surfaces configured to shape an electrostatic field to avoid divergence of beam profiles. By avoiding beam profile divergence, the modification in the example shown in FIGS. 6 and 7 leads to improved precision and accuracy of ion beam detection. Each of beams 210*a*, 210*b*, and 210*g* exhibits essentially the same width.

As may be appreciated from the discussion above, another aspect of the invention involves an EDL including a case surface and at least one electrode surface. The EDL is configured to receive through the EDL a plurality of spatially separated ion beams, to generate an electrostatic field between the one electrode surface and either the case surface or another electrode surface, and to increase the separation between the beams using the field. The one electrode surface and either the case surface or the other electrode surface have geometries configured to shape the field to exhibit a less abrupt entrance and/or exit field transition in comparison to another electrostatic field. The other electrostatic field is shaped by two nested, one-quarter section, right cylindrical electrode surfaces held at opposite voltages with a constant gap width between the cylindrical electrode surfaces.

By way of example, the EDL may be configured to receive the beams with equal kinetic energies upon entering the field. In keeping with the design goals described herein, the geometries of the one electrode surface and either the case surface or the other electrode surface may be configured to shape the field to avoid variance in beam-to-beam dispersion when at least three beams are present. Also, the geometries of the one electrode surface and either the case surface or the other electrode surface may be configured to shape the field to avoid divergence of beam profiles. Further, the geometries of the one electrode surface and either the case surface or the other electrode surface may be configured to shape the field to conserve or improve on z-axis focusing of the beams.

FIGS. 8-16 show and evaluate electrode geometries that also address the competing design goals. As one example, the at least one electrode surface of the various EDL embodiments described herein may be a single electrode surface including an approximate one-quarter section of an ellipsoid, where an ellipsoid is known as a surface all plane sections of which are ellipses or circles. The case surface may include an opposing approximate one-quarter section of the ellipsoid and a split cylindrical rod centered about a common axis of the ellipsoid corresponding to the two one-quarter sections.

FIGS. 8-13 show various views and sections of an EDL including an electrode 302 separated by a gap 304 from a case 306 to electrically isolate the components. Case 306 includes a split cylindrical rod 308 centered about a common axis of an ellipsoidal interior surface 314 of electrode 302 and an ellipsoidal portion of an interior surface 316 of case 306. Interior surface 314 and the ellipsoidal portion of interior surface 316 include approximate one-quarter sections of an ellipsoid. The sections are "approximate" one-quarter sections to account for the presence of gap 304 while still maintaining a common ellipsoidal axis corresponding to the two one-quarter sections. Notably, interior surface 316 of case 306 includes the perimeter surface of rod 308, denoted as part of the case, even though such rod surface is not specifically numbered as interior surface 316 to avoid confusion.

The EDL includes an entry/exit aperture 312 to receive ion beams 310. Due to the extremely wide angular dispersion of beams 310, they also exit the EDL through the wide slot in the EDL forming entry/exit aperture 312. As will be appreciated, applying a potential of +10,000 volts to electrode 302 while case 306 (including rod 308) is at ground potential (10,000 volts difference) may generate an electrostatic field sufficient to disperse 5 kV ion beams in the manner shown in FIGS. 8-13.

FIG. 14 shows a SIMION simulation of operating the FIGS. 8-13 EDL. The simulation includes an upper potential 322 at +10,000 volts and a lower potential 324 at ground potential. In this simulation, lower potential 324 corresponds with a mid-plane 328 constituting a z-axis focus plane of beams 310 prior to entry into an after exit from the EDL. As in the other simulations discussed herein, beams 310 move onto energy surface 326, simulating a change in their kinetic energy induced by the electrostatic field generated between electrode 302 and case 306.

While the simulation shown in FIG. 3 provides a balanced compromise of competing design goals for an EDL, the simulation shown in FIG. 14 emphasizes beam dispersion and, for ion beams separated according to mass, provides a greatly enhanced mass range for the ion beams dispersed. The FIG. 14 simulation includes 18 ion beams and effectively disperses such beams within a very wide angle in comparison to the FIG. 3 simulation including only 6 ion beams dispersed over a much narrower angle. As a result, the range of ion beam masses potentially dispersed with the EDL of FIGS. 8-13 exceeds that of the EDL in FIGS. 2, 4, and 5. However, as may be understood from discussion above of competing design goals, the enhanced mass range and angular dispersion may come at the expense of variance in beam-to-beam dispersion and divergence of beam profiles.

The simulation revealed that some of beams 310 exhibit beam broadening. Also, FIG. 14 (and FIG. 12) shows variance in beam-to-beam dispersion. The complex three-dimensional ellipsoid geometry of interior surface 314 of electrode 302 provides a repelling electrode surface to disperse beams 310. Split cylindrical rod 308 centrally located between interior surface 314 and interior surface 316 shapes the electrostatic field formed between the electrode surface and the case surface. Energy surface 326 shown in FIG. 14 exhibits a very gradual entrance and exit field transition which is much less abrupt in comparison to the entrance and exit field transitions shown in FIG. 1 for the Appelhans '821 EDL. For the simulated asymmetric design, the EDL may be positioned such that the beams' focal points occur just after entering the electrostatic field of the EDL to produce the best results.

Z-axis focusing of the beams represents another design consideration. The EDL of FIGS. 8-13 and the EDL of FIGS. 2, 4, and 5 exhibit differences in symmetry along the z-direction. Consequently, z-axis focusing differs in the ellipsoid EDL compared to the other EDL. As is most readily apparent from FIG. 11, the aspect ratio of the ellipsoid dimensions of the minor axes in the horizontal and vertical directions is equal to 1 since the horizontal diameter and the vertical diameter are the same. However, altering the aspect ratio by, for example, providing a larger vertical diameter in comparison to the horizontal diameter may act to control beam spread in the z-direction. That is, even though FIGS. 8-13 show the ellipsoid surfaces as prolate spheroid surfaces, other ellipsoid geometries may be useful. A prolate spheroid is an ellipsoid of revolution generated by revolving an ellipse about its major axis. Aspect ratio of the ellipsoid EDL may be selected for a particular mass range of ion beams. Different mass ranges of ion beams may warrant different aspect ratios to obtain a desired degree of z-axis focusing.

The tradeoffs among the competing design goals for an EDL are apparent in the embodiment of FIGS. 8-14 which provides an increased mass range and enhanced angular dispersion while improving z-axis beam focusing, but introducing divergence of beam profiles and variance in beam-to-beam dispersion. Despite the tradeoffs, such embodiment exhibits significant advantages, in some respects, in comparison to the Appelhans '821 EDL.

FIG. 15 shows a cutaway perspective view of an EDL including an electrode 402 separated by a gap 404 from a case 406 to electrically isolate the components. Case 406 includes an interior surface 416 as a case surface and electrode 402 includes an interior surface 414 as an electrode surface. Interior surface 414 is a center approximate one-third section of an approximate one-half of a square cuboid. Interior surface 416 includes the other approximate five-sixths of the square cuboid. A cuboid is known as a surface approximately cubic in shape, such as a rectangular parallelepiped.

An entry/exit aperture 412 is provided to receive ion beams 410. Due to the extremely wide angular dispersion of beams 410 they also exit the EDL through entry/exit aperture 412. As will be appreciated, applying a potential of +10,000 volts to electrode 402 while case 406 is at ground potential (10,000 volt difference) may generate an electrostatic field sufficient to disperse 5 kV ion beams in the manner shown in FIG. 15.

FIG. 16 shows a SIMION simulation of operating the FIG. 15 EDL. The simulation includes an upper potential 422 at +10,000 volts and a lower potential 424 at ground potential. In this simulation, lower potential 424 corresponds with a mid-plane 428 constituting a z-axis focus plane of beams 410 prior to entry into and after exit from the EDL. As in the other simulations discussed herein, beams 410 move onto energy surface 426, simulating a change in their kinetic energy induced by the electrostatic field generated between electrode 402 and case 406.

Similar to the ellipsoid EDL, the cuboid EDL of FIG. 15 enhances the mass range of beams 410 and provides a very wide angular dispersion. For the simulated asymmetric design, the EDL may be positioned such that the beams' focal points occur just after entering the electrostatic field of the EDL to produce the best results.

In addition to the various apparatuses described herein, aspects of the invention also include ion beam dispersion methods. According to one aspect of the invention, a dispersion method includes providing a plurality of spatially separated ion beams and directing the beams through an EDL including a case surface and at least one electrode surface. The method includes generating an electrostatic field between the one electrode surface and either the case surface or another electrode surface and increasing the separation between the beams using the field. Other than an optional mid-plane containing intended trajectories of the beams, the electrode surface or surfaces do not exhibit a plane of symmetry through which any beam received through the EDL must pass.

By way of example, the beams may have equal kinetic energies upon entering the field. Also, generating the field may include applying to the one electrode a voltage different from either a voltage of the case surface or a voltage of the other electrode surface. The case surface may be operated at ground potential. The one electrode surface and either the case surface or the other electrode surface may have geometries that shape the field to exhibit a less abrupt entrance and/or exit field transition in comparison to another electrostatic field shaped by two nested, one-quarter section, right cylindrical electrode surfaces held at opposite voltages with a constant gap width between the cylindrical electrode surfaces.

According to another aspect of the invention, a dispersion method includes providing a plurality of spatially separated ion beams and directing the beams through an EDL including a case surface and at least one electrode surface. The method includes generating an electrostatic field between the one electrode surface and either the case surface or another electrode surface and increasing the separation between the beams using the field. The electrostatic field is shaped by geometries of the one electrode surface and either the case surface or the other electrode surface. The geometries shape the field to exhibit a less abrupt entrance and/or exit field transition in comparison to another electrostatic field shaped by two nested, one-quarter section, right cylindrical electrode surfaces held at opposite voltages with a constant gap width between the cylindrical electrode surfaces.

By way of example, the geometries of the one electrode surface and either the case surface or the other electrode surface may shape the field and avoid variance in beam-to-beam dispersion when at least three beams are present. Also, the geometries of the one electrode surface and either the case surface or the other electrode surface may shape the field and avoid divergence of beam profiles. Further, the geometries of the one electrode surface and either the case surface or the other electrode surface may shape the field and conserve or improve on z-axis focusing of the beams. Other operational parameters discussed herein regarding other aspects of the invention may be implemented in the controlled field transition method of the present aspect of the invention.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. An electrostatic dispersion lens (EDL) comprising:

a case surface;

at least one electrode surface;

the EDL being configured to receive through the EDL a plurality of spatially separated ion beams, to generate an electrostatic field between the one electrode surface and either the case surface or another electrode surface, and to increase the separation between the beams using the field; and other than an optional mid-plane intended to contain trajectories of the beams, the electrode surface or surfaces not exhibiting a plane of symmetry through which any beam received through the EDL must pass.

2. The EDL of claim 1 wherein the EDL is configured to receive the beams with equal kinetic energies upon entering the field.

3. The EDL of claim 1 wherein the one electrode surface and either the case surface or the other electrode surface have geometries configured to shape the field to exhibit a less abrupt entrance and/or exit field transition in comparison to another electrostatic field shaped by two nested, one-quarter section, right cylindrical electrode surfaces held at opposite voltages with a constant gap width between the cylindrical electrode surfaces.

4. The EDL of claim 1 wherein the at least one electrode surface is a single electrode surface comprising an approximate one-quarter section of an ellipsoid, the case surface comprising an opposing approximate one-quarter section of the ellipsoid and a split cylindrical rod centered about a common axis of the two one-quarter sections.

5. The EDL of claim 1 wherein the at least one electrode surface is a single electrode surface comprising a center approximate one-third section of an approximate one-half of a square cuboid, the case surface comprising the other approximate five-sixths of the square cuboid.

6. The EDL of claim 1 wherein the at least one electrode surface comprises an outer electrode surface including a one-quarter section, right cylindrical electrode surface as the one electrode surface and a nested inner electrode surface including a one-quarter section, right cylindrical portion and a tangential extension portion as the other electrode surface, the extension portion being positioned at an entrance to the field and a constant gap width existing between the outer electrode surface and the cylindrical portion of the inner electrode surface.

7. A mass spectrometer comprising the EDL of claim 1.

8. An EDL comprising:

a case surface;

at least one electrode surface;

the EDL being configured to receive through the EDL a plurality of spatially separated ion beams, to generate an electrostatic field between the one electrode surface and either the case surface or another electrode surface, and to increase the separation between the beams using the field; and the one electrode surface and either the case surface or the other electrode surface having geometries configured to shape the field to exhibit a less abrupt entrance and/or exit field transition in comparison to another electrostatic field shaped by two nested, one-quarter section, right cylindrical electrode surfaces held at opposite voltages with a constant gap width between the cylindrical electrode surfaces.

9. The EDL of claim 8 wherein the EDL is configured to receive the beams with equal kinetic energies upon entering the field.

10. The EDL of claim 8 wherein the geometries of the one electrode surface and either the case surface or the other electrode surface are configured to shape the field to avoid variance in beam-to-beam dispersion when at least three beams are present.

11. The EDL of claim 8 wherein the geometries of the one electrode surface and either the case surface or the other electrode surface are configured to shape the field to avoid divergence of beam profiles.

12. The EDL of claim 8 wherein the geometries of the one electrode surface and either the case surface or the other electrode surface are configured to shape the field to conserve or improve on z-axis focusing of the beams.

13. The EDL of claim 8 wherein the at least one electrode surface is a single electrode surface comprising an approximate one-quarter section of an ellipsoid, the case surface comprising an opposing approximate one-quarter section of the ellipsoid and a split cylindrical rod centered about a common axis of the two one-quarter sections.

14. The EDL of claim 8 wherein the at least one electrode surface is a single electrode surface comprising a center approximate one-third section of an approximate one-half of a square cuboid, the case surface comprising the other approximate five-sixths of the square cuboid.

15. The EDL of claim 8 wherein the at least one electrode surface comprises an outer electrode surface including a one-quarter section, right cylindrical electrode surface as the one electrode surface and a nested inner electrode surface including a one-quarter section, right cylindrical portion and a tangential extension portion as the other electrode surface, the extension portion being positioned at an entrance to the field and a constant gap width existing between the outer electrode surface and the cylindrical portion of the inner electrode surface.

16. A mass spectrometer comprising the EDL of claim 8.

17. An ion beam dispersion method comprising:

providing a plurality of spatially separated ion beams;

directing the beams through an EDL including a case surface and at least one electrode surface;

generating an electrostatic field between the one electrode surface and either the case surface or another electrode surface, other than an optional mid-plane containing intended trajectories of the beams, the electrode surface or surfaces not exhibiting a plane of symmetry through which any beam received through the EDL must pass; and increasing the separation between the beams using the field.

18. The method of claim 17 wherein an ion source of a mass spectrometer provides the ions that form the beams.

19. The method of claim 17 wherein the beams have equal kinetic energies upon entering the field.

20. The method of claim 17 wherein generating the field comprises applying to the one electrode surface a voltage different from either a voltage of the case surface or a voltage of the other electrode surface.

21. The method of claim 17 wherein the case surface is at ground potential.

22. The method of claim 17 wherein the one electrode surface and either the case surface or the other electrode surface have geometries that shape the field to exhibit a less abrupt entrance and/or exit field transition in comparison to another electrostatic field shaped by two nested, one-quarter section, right cylindrical electrode surfaces held at opposite voltages with a constant gap width between the cylindrical electrode surfaces.

23. The method of claim 17 wherein the at least one electrode surface is a single electrode surface comprising an approximate one-quarter section of an ellipsoid, the case surface comprising an opposing approximate one-quarter section of the ellipsoid and a split cylindrical rod centered about a common axis of the two one-quarter sections.

24. The method of claim 17 wherein the at least one electrode surface is a single electrode surface comprising a center approximate one-third section of an approximate one-half of a square cuboid, the case surface comprising the other approximate five-sixths of the square cuboid.

25. The method of claim 17 wherein the at least one electrode surface comprises an outer electrode surface including a one-quarter section, right cylindrical electrode surface as the one electrode surface and a nested inner electrode surface including a one-quarter section, right cylindrical portion and a tangential extension portion as the other electrode surface, the extension portion being positioned at an entrance to the field and a constant gap width existing between the outer electrode surface and the cylindrical portion of the inner electrode surface.

26. An ion beam dispersion method comprising:

providing a plurality of spatially separated ion beams;

directing the beams through an EDL including a case surface and at least one electrode surface;

generating an electrostatic field between the one electrode surface and either the case surface or another electrode surface, the electrostatic field being shaped by geometries of the one electrode surface and either the case surface or the other electrode surface, the geometries shaping the field to exhibit a less abrupt entrance and/or exit field transition in comparison to another electrostatic field shaped by two nested, one-quarter section, right cylindrical electrode surfaces held at opposite voltages with a constant gap width between the cylindrical electrode surfaces; and increasing the separation between the beams using the field.

27. The method of claim 26 wherein an ion source of a mass spectrometer provides the ions that form the beams.

28. The method of claim 26 wherein the beams have equal kinetic energies upon entering the field.

29. The method of claim 26 wherein generating the field comprises applying to the one electrode surface a voltage different from either a voltage of the case surface or a voltage of the other electrode surface.

30. The method of claim 26 wherein the case surface is at ground potential.

31. The method of claim 26 wherein the geometries of the one electrode surface and either the case surface or the other electrode surface shape the field and avoid variance in beam-to-beam dispersion when at least three beams are present.

32. The method of claim 26 wherein the geometries of the one electrode surface and either the case surface or the other electrode surface shape the field and avoid divergence of beam profiles.

33. The method of claim 26 wherein the geometries of the one electrode surface and either the case surface or the other electrode surface shape the field and conserve or improve on z-axis focusing of the beams.

34. The method of claim 26 wherein the at least one electrode surface is a single electrode surface comprising an approximate one-quarter section of an ellipsoid, the case surface comprising an opposing approximate one-quarter section of the ellipsoid and a split cylindrical rod centered about a common axis of the two one-quarter sections.

35. The method of claim 26 wherein the at least one electrode surface is a single electrode surface comprising a center approximate one-third section of an approximate one-half of a square cuboid, the case surface comprising the other approximate five-sixths of the square cuboid.

36. The method of claim 26 wherein the at least one electrode surface comprises an outer electrode surface including a one-quarter section, right cylindrical electrode surface as the one electrode surface and a nested inner electrode surface including a one-quarter section, right cylindrical portion and a tangential extension portion as the other electrode surface, the extension portion being positioned at an entrance to the field and a constant gap width existing between the outer electrode surface and the cylindrical portion of the inner electrode surface.

* * * * *